United States Patent [19]

Appel et al.

[11] Patent Number: 4,923,628

[45] Date of Patent: May 8, 1990

[54] HIGH BULK DENSITY DETERGENT COMPOSITION AND PROCESS FOR ITS PRODUCTION

[75] Inventors: Peter W. Appel, Rotterdam; Huug Euser, Vlaardingen; Seeng D. Liem, Rhoon, all of Netherlands

[73] Assignee: Lever Brothers Company, New York, N.Y.

[21] Appl. No.: 327,419

[22] Filed: Mar. 20, 1989

Related U.S. Application Data

[63] Continuation of Ser. No. 915,194, Oct. 3, 1986, abandoned.

[30] Foreign Application Priority Data

Oct. 14, 1985 [GB] United Kingdom ..... 8525269

[51] Int. Cl.[5] ..... C11D 3/065; C11D 3/14; C11D 11/02; C11D 17/06

[52] U.S. Cl. ..... 252/135; 252/174.14; 252/174.21; 252/174.25; 252/540; 252/559

[58] Field of Search ..... 252/133, 135, 174.14, 252/174.21, 174.25, 540, 559

[56] References Cited

U.S. PATENT DOCUMENTS

| | | | |
|---|---|---|---|
| 3,700,600 | 10/1972 | Nagel et al. | 252/99 |
| 3,753,930 | 8/1973 | Weldes et al. | 252/527 |
| 4,000,080 | 12/1976 | Bartolotia et al. | 252/99 |
| 4,136,051 | 1/1979 | Saran et al. | 252/91 |
| 4,460,491 | 7/1984 | Liem | 252/174.25 |
| 4,639,326 | 1/1987 | Czempik et al. | 252/91 |
| 4,650,699 | 3/1987 | Farnworth et al. | 252/99 |

FOREIGN PATENT DOCUMENTS 168102 1/1986 European Pat. Off. .

OTHER PUBLICATIONS

Chemical Abstracts 100 158590k—Abstract of Japanese Patent 83/213,099A, 12/'83.

*Primary Examiner*—Paul Lieberman
*Assistant Examiner*—A. Beadles-Hay
*Attorney, Agent, or Firm*—Matthew J. McDonald

[57] ABSTRACT

A granular low-phosphate detergent composition is prepared by spray-drying a slurry to give a base powder containing a low to moderate level of sodium tripolyphosphate and low levels of inorganic salts, then post-dosing solid material, including sodium sulphate, of high bulk density and of smaller particle size than the base powder. The resulting product has a bulk density at least 150 g/liter greater than that of the base powder and shows improved dispensing properties in an automatic washing machine.

22 Claims, No Drawings

HIGH BULK DENSITY DETERGENT COMPOSITION AND PROCESS FOR ITS PRODUCTION

This is a continuation application of Ser. No. 915,194, filed Oct. 3, 1986, now abandoned.

TECHNICAL FIELD

The present invention is concerned with granular detergent compositions prepared by spray-drying. The present invention is also concerned with powders in which the phosphate level has been reduced in response to legislation intended to control the eutrophication of inland waters. More particularly, the invention is concerned with powders containing not more than 25% by weight of sodium tripolyphosphate.

BACKGROUND AND PRIOR ART

Spray-dried detergent compositions containing sodium tripolyphosphate are exceedingly well known. Sodium tripolyphosphate is a highly efficient detergency builder and its hexahydrate forms on spray-drying needle-shaped crystals which constitute an excellent porous matrix or carrier material for the organic components, notably detergent-active compounds, in the composition. Spray-dried granules containing sodium tripolyphosphate are of high particle porosity; accordingly such spray-dried powders tend to have relatively low bulk density, for example, of the order of 450 g/liter. While the porosity and structure of these granules can be highly advantageous in terms of capacity for carrying organic components and powder properties, they are necessarily associated with relatively low bulk density.

A conventional spray-dried powder built with sodium tripolyphosphate is prepared by spray-drying an aqueous slurry which will contain other salts, notably sodium sulphate, sodium carbonate, and sodium silicate, as well as the sodium tripolyphosphate. These salts, which perform various functions in the wash liquor, also may contribute to the structure of the spray-dried particles. Phosphate-built powders presently on the European market typically contain about 20 to 35% of sodium sulphate.

It has already been suggested that instead of including all the desired amount of sodium sulphate in the slurry, a part of it should be postdosed, that is to say, admixed afterwards with the spray-dried base powder. For example, one powder currently available on the French market contains 20% sodium sulphate, of which 2.5% (based on the whole powder) is included in the slurry and 17.5% postdosed. The slurry also contains 5% sodium carbonate. This powder contains a relatively high level of sodium tripolyphosphate (31%), all of which is included in the slurry. The bulk density of the final powder is about 560 g/liter.

EP 168 102A (Unilever), published on January 15, 1986, describes and claims a process for the preparation of a high bulk density detergent powder containing anionic and nonionic surfactants. A spray-dried base powder essentially free of sodium sulphate and containing some nonionic surfactant is prepared, and the remaining nonionic surfactant is in part sprayed onto the base powder and in part sorbed onto a carrier (zeolite plus sodium perborate monohydrate) and postdosed. Two powders, containing respectively 32% and 29.5% by weight of sodium tripolyphosphate, are described in the Examples; the postdosed zeolite/perborate/nonionic surfactant material in each case contains a low level (2.24% and 5.252% by weight respectively) of sodium sulphate.

JP 83/213 099A (Kao Corporation), Chemical Abstracts 100 158590k, discloses a detergent powder with good anticaking properties prepared by mixing 60 to 95 parts of spray-dried base powder with 5 to 40 parts of sodium carbonate of apparent specific gravity 0.25 to 0.70 g/ml (250 to 700 g/liter), average particle diameter 250 to 600 μm and containing >20% of particles <125 μm.

U.S. Pat. No. 3,573,930 (Philadelphia Quartz Co./-Weldes et al) discloses a detergent composition prepared by a process in which a spray-dried base powder containing surfactant, builder, a low level (about 2%) of sodium silicate, and minor ingredients is first prepared, and a mixture consisting predominantly of solid hydrated sodium silicate is postdosed to the base powder.

U.S. Pat. No. 4,136,051 (Henkel KGaA/Saran et al) discloses another detergent composition prepared by a combination of spray-drying and postdosing. The postdosed material comprises sodium silicate, bleaching compounds and nonionic surfactant.

The present invention is based on the discovery that the bulk density of spray-dried powders can be increased substantially, without detriment to powder properties (flow, compressibility, resistance to caking, ease of dispensing), by a method which combines spray-drying a slurry of low salt content with postdosing a relatively high level of sodium sulphate of defined bulk density and particle size distribution, provided that the content of sodium tripolyphosphate in the base powder does not exceed a particular level.

DEFINITION OF THE INVENTION

The present invention provides a process for the preparation of a low-phosphate granular detergent composition comprising one or more anionic and/or nonionic detergent-active compounds, from 10 to 25% by weight of sodium tripolyphosphate, and sodium sulphate, which is characterised by the steps of:

(i) spray-drying an aqueous slurry comprising from 10 to 25% by weight of sodium tripolyphosphate, optionally from 0 to 6% by weight of sodium silicate, optionally from 0 to 20% by weight of sodium sulphate and/or sodium carbonate, and optionally one or more anionic and/or nonionic detergent-active compounds, to form a spray-dried base powder;

(ii) postdosing to from 40 to 75% by weight of said spray-dried base powder from 20 to 35% by weight of sodium sulphate; and (iii) optionally postdosing from 0 to 40% by weight of other solid and/or liquid material; the sodium sulphate postdosed in step (ii) and any solid material postdosed in step (iii) having an overall bulk density of at least 1000 g/liter and an overall Rosin-Rammler average particle size not exceeding 75% of the Rosin-Rammler average particle size of the base powder; the final composition having a bulk density at least 150 g/liter greater than that of the base powder; all percentages being based on the final composition.

The present invention further provides a low-phosphate granular detergent composition comprising one or more anionic and/or nonionic detergent-active compounds, sodium tripolyphosphate, and sodium sulphate, characterised in that:

(a) the composition contains a total of from 10 to 25% by weight of sodium tripolyphosphate;

(b) the composition has a bulk density of at least 650 g/liter;

(c) the composition comprises:

(i) from 40 to 75% by weight of a spray-dried base powder containing from 10 to 25% by weight of sodium tripolyphosphate, optionally from 0 to 20% by weight of sodium sulphate and/or sodium carbonate, and optionally one or more anionic and/or nonionic detergent-active compounds, the base powder having a Rosin-Rammler average particle size within the range of from 350 to 800 μm;

(ii) from 20 to 35% by weight of postdosed sodium sulphate; and (iii) optionally from 0 to 40% by weight of other postdosed material, the postdosed sodium sulphate (ii) and any other solid postdosed material (iii) having an overall Rosin-Rammler average particle size not exceeding 75% of the Rosin-Rammler average particle size of the base powder (i); all percentages being based on the final composition.

Throughout the present specification, all percentages quoted are by weight based on the final product unless otherwise stated.

DESCRIPTION OF THE INVENTION

The low-phosphate granular detergent powder of the present invention is prepared by a two-stage process. In the first stage, a slurry containing sodium tripolyphosphate (STP), optionally anionic and/or nonionic detergent-active compounds, optionally low levels of salts as discussed below, and optionally other non-heat-sensitive components is spray-dried to form a base powder. The total STP content of the final product is from 10 to 25% by weight, and preferably most or all of this is incorporated via the slurry.

The invention is of especial interest for powders containing 20 to 25% by weight of STP: at these STP levels no other builder is required. At lower STP levels (10 to 20% by weight) supplementary builders and/or structurants may be required, and these may be organic or inorganic, water-soluble or water-insoluble. Examples of suitable supplementary builders and structurants will readily suggest themselves to those skilled in the art, and include crystalline and amorphous aluminosilicates; monomeric and polymeric polycarboxylates such as citrates, nitrilotriacetates and acylic homo- and copolymers; and inorganic salts such as sodium carbonate. Any supplementary builder will generally be incorporated via the slurry, but in the case of sodium carbonate some postdosing may be desirable in view of the necessity to keep the salt level in the slurry below the 20% (final product basis) maximum.

The amount of detergent-active material included in the final product will generally range from 5 to 40% by weight. This need not be included in the slurry: for example, liquid nonionic surfactant may subsequently be sprayed onto the base powder, or sorbed onto a solid carrier material and postdosed, while anionic surfactants, for example, alkylbenzene sulphonates, are conveniently incorporated via the slurry. The slurry, and hence the base powder, will, however, generally contain some detergent-active material.

Suitable detergent-active compounds will be well known to those skilled in the art and are fully described in the literature, for example, in "Surface Active Agents and Detergents", Volumes I and II, bu Schwartz, Perry and Berch. Examples of suitable anionic surfactants include alkylbenzene sulphonates, alkyl sulphates, alkyl ether sulphates, alkane sulphonates, olefin sulphonates and fatty acid ester sulphonates. Examples of nonionic surfactants include fatty alcohol ethoxylates, alkyl phenol ethoxylates, amine oxides, and fatty acid mono- and diethanolamides. Preferred compositions of the present invention contain both anionic and nonionic surfactants.

Especially preferred for use in the present invention are $C_8$–$C_{22}$ linear alkylbenzene sulphonates, $C_8$–$C_{22}$ alcohol 2-30EO ethoxylates, and mixtures thereof.

Other non-heat-sensitive ingredients may be included in the slurry, for example, antiredeposition agents such as sodium carboxymethyl cellulose, and fluorescers.

The slurry may also if desired contain up to 6% by weight (based on the final product) of sodium silicate. This material reduces corrosion of metal washing machine surfaces and also improves powder structure.

It is essential that the total level of sodium sulphate and sodium carbonate in the slurry should not exceed 20% by weight based on the final product: preferably this level does not exceed 10% by weight, while the preferred maximum level for each of the individual salts is 5%. Most preferably the slurry is substantially free of these salts, other than any small quantities of sodium sulphate introduced as impurities in other materials, for example, anionic surfactants.

The spray-dried base powder thus has a relatively low level of STP, compared with conventional phosphate-built powders, and a low or zero level of sodium sulphate and/or sodium carbonate. The particle size will generally be relatively large, a Rosin-Rammler average particle size within the range of from 350 to 800 μm being typical, and one of 500 to 750 μm being preferred.

Because of the low salt level in the slurry, the base powder will be of lower particle porosity, and hence of higher bulk density, than similar base powders prepared from conventional slurries containing high levels of inorganic salts. The absolute value of the bulk density will of course depend on the amounts and types of any surfactants present, but may typically lie within the range of from 400 to 600 g/liter.

In accordance with the invention, a further substantial increase in bulk density, of at least 150 g/liter, preferably at least 200 g/liter, is obtained by filling the voids between the relatively large particles of base powder with postdosed solid material, including a substantial proportion of sodium sulphate, in the form of a finely divided dense powder of low porosity. The process of the invention is thus especially valuable for the production of detergent powders having a high bulk density, for example, above 650 g/liter, especially from 675 to 850 g/liter.

The postdosed solid material must itself be of high bulk density: at least 1000 g/liter, preferably at least 1050 g/liter. These figures apply to the totality of postdosed solid material, that is to say, to a mixture of all the postdosed solids in the proportions in which they are to be present in the final product. In reality, of course, the various solids are likely to be dosed separately to the base powder, and some will have higher bulk densities than the overall figure while others will have lower bulk densities. In a preferred embodiment of th invention, the sodium sulphate postdosed is of especially high bulk density: at least 1200 g/liter, preferably at least 1300 g/liter. This allows greater flexibility in the choice of any other solid postdosed ingredients. The higher the bulk density of the postdosed material, the greater the density increase that can be achieved by postdosing, but in practice it is difficult to obtain or prepare sodium sulphate having a bulk density greater than 1600 g/liter.

The bulk density benefits of the present invention are especially apparent in products in which the ratio of anionic surfactant to nonionic surfactant is high, for example, greater than 1:1 by weight. In such products the reduction in particle porosity achieved by reducing salt levels in the slurry is particularly marked.

The particle size of the postdosed solid material is also carefully defined, in terms of the Rosin-Rammler distribution described by Rosin and Rammler, J.Inst. Fuel 7 29-36 (1933).

The Rosin-Rammler average particle size of the postdosed solid material does not exceed 75% of that of the base powder, and preferably does not exceed 70%. If the base powder generally has a particle size of 350 to 800 μm, the upper limit for the postdosed solid material will be 263 to 600 μm, preferably 245 to 560 μm. An especially preferred particle size range for the postdosed solid material, in absolute terms, is the range of from 200 to 400 μm.

As with the bulk density figures quoted earlier, these average particle sizes are overall figures for the totality of posdosed solid material.

In general, the man skilled in the art will have no difficulty in preparing sodium sulphate and other materials of suitable granulometry for postdosing. Commercial materials of large particle size can be ground and sieved while very fine materials can be compacted and sieved.

Matching of the granulometry of the postdosed solid material to that of the base powder will give the maximum possible increase in bulk density as a result of the postdosing operation. A detergent composition produced by the process of the invention will have a particle size distribution such that the larger particles are predominantly derived from the spray-dried base powder while the smaller particles are predominantly derived from the postdosed solid materials, including sodium sulphate.

The invention offers another important benefit in addition to increased bulk density. Powders prepared in accordance with the invention, composed of a relatively coarse base powder and relatively fine postdosed material, have surprisingly been found to exhibit significantly better dispensing properties in the washing machine, as compared with powders having a similar particle size distribution but composed of a relatively fine base powder and relatively coarse postdosed material.

In this context, it is strongly preferred that the postdosed material should not contain too high a level of very small particles or "fine": the content of particles smaller than 125 μm is preferably less than 15% by weight, and more preferably less than 10% by weight. The "fines" content of the base powder is also preferably less than 15% by weight.

The final detergent powder produced by the process of the invention contains from 40 to 75% by weight of spray-dried base powder and from 20 to 35% by weight of postdosed sodium sulphate. The balance, if any, will consist of other material added after the spray-drying operation, that is to say, other postdosed solids and/or liquids, but it is preferred that sodium sulphate should constitute at least 50% by weight of the total postdosed material. Examples of the sort of ingredients that are normally added by postdosing will be well known to the man skilled in the art, and include bleaching agents (persalts such as sodium perborate; bleach activators such as tetraacetylethylene diamine; bleach stabilisers; peroxyacids), enzymes, lather suppressors, nonionic surfactants, dyes and perfumes. Liquid components may, for example, be sprayed onto the base powder; encapsulated in a solid coating material and postdosed; or sprayed onto a porous solid carrier and postdosed.

As mentioned earlier, it is preferred that substantially all the STP in the compositions of the invention be incorporated in the base powder. Small amounts of STP may, however, be present in some postdosed ingredients, for example, TAED granules. Preferably not more than 5% by weight of STP, based on the final composition, is postdosed.

The process of the present invention gives yet another benefit when operated in a continuous manner in that the spray-drying step (i) has been found to give powders in which the degree of hydration of sodium tripolyphosphate is substantially higher, for example 90% rather than 50%, than in otherwise similar powders derived from slurries containing higher levels of salts, and in which the crystal size of the sodium tripolyphosphate is small (<25 μm). In low-phosphate powders it is particularly important to maximise the degree of hydration of the sodium tripolyphosphate present, and to obtain small crystal sizes, in order to optimise the structure of the powder and thus achieve acceptable flow and crispness properties. In a batch process this advantage is less relevant but operation in accordance with the invention provides additional flexibility in that low-phosphate powders can be produced either by continuous or batch processing without detriment to powder properties. Additional flexibility is also provided in that good structure appears to be obtained regardless of the quality of the sodium tripolyphosphate used.

Yet another advantage associated with the invention is that the elimination of salts from the slurry, or at least the reduction of salt levels in the slurry, allows more economic use of spray-drying facilities, because production at higher throughputs can be achieved.

EXAMPLES

The invention is further illustrated by the following non-limiting Examples.

EXAMPLE 1

Using a continuous process, a slurry was prepared and spray-dried to give a base powder containing the following ingredients (by weight):

| | % |
|---|---|
| Sodium linear alkylbenzene sulphonate | 9.0 |
| Nonionic detergent | 1.0 |
| Sodium tripolyphosphate | 21.5 |
| Alkaline sodium silicate | 5.5 |
| Minor ingredients (fluorescer. antiredeposition agent etc) | 3.26 |
| Moisture | 8.00 |
| | 48.26 |

The spray-dried base powder was crisp and free-flowing, and had a bulk density of 500 g/liter. The Rosin-Rammler average particles size was 500 μm and the content of fines (<125 μm) was less than 6%. It will be noted that the slurry contained no water-soluble inorganic salts except sodium tripolyphosphate and sodium silicate, other than the minor amounts of salts inevitably present as impurities, for example, in the alkylbenzene sulphonate.

To the spray-dried powder were postdosed the following ingredients:

| | % |
|---|---|
| Sodium sulphate (anhydrous) | 32.12 |
| Sodium carbonate (anhydrous) | 5.0 |
| Bleach ingredients (sodium perborate, TAED, stabilizer) and minor ingredients (enzyme, lather suppressor, perfume etc) | 11.63 |
| Nonionic detergent | 3.0 |
| | 51.74 |

The bulk density of the postdosed material was 1100 g/liter, its Rosin-Rammler average particle size was 350 μm (70% of that of the base powder), and the fines content (<125 μm) was less than 10%.

The bulk density of the postdosed sodium sulphate was 1580 g/liter, its Rosin-Rammler average particle size was 290 μm (58% of that of the base powder), and the fines content (<125 μm) was less than 15%. It will be noted that this material constituted 62% of the postdosed ingredients.

The final powder had a bulk density of 730 g/liter (230 g/liter greater than that of the base powder) and had excellent powder properties; it was crisp and free-flowing, with a dynamic flow rate of 101 ml/s, and showed no tendency to segregate. The degree of hydration of the sodium tripolyphosphate was shown by X-ray diffraction analysis to be about 90%.

EXAMPLE 2

Using a batch process, a slurry was prepared and spray-dried to give a base powder containing the following ingredients (by weight):

| | % |
|---|---|
| Sodium linear alkylbenzene sulphonate | 9.0 |
| Nonionic detergent | 1.0 |
| Sodium tripolyphosphate | 23.3 |
| Sodium sulphate | 6.0 |
| Sodium carbonate | 5.0 |
| Alkaline sodium silicate | 6.0 |
| Minor ingredients (fluorescer, antiredeposition agent etc) | 2.7 |
| Moisture | 10.5 |
| | 63.5 |

The spray-dried base powder was crisp and free-flowing, the dynamic flow rate being 115 ml/s. The bulk density was 510 g/liter, the Rosin-Rammler average particle size was 550 μm and the fines content (<125 μm) was less than 4.4%. It will be noted that in this example the slurry contained a low level (11% based on the final formulation) of water-soluble inorganic salts (sodium sulphate and sodium carbonate).

To the spray-dried powder were postdosed the following ingredients:

| | % |
|---|---|
| Sodium sulphate (anhydrous) | 20.5 |
| Sodium carbonate | 1.0 |
| Bleach ingredients (sodium perborate, TAED, stabilizer) and minor ingredients (enzyme, lather suppressor, perfume etc) | 12.0 |
| Nonionic detergent | 3.0 |

-continued

| | % |
|---|---|
| | 36.50 |

The bulk density of the postdosed material was 1075 g/liter, its Rosin-Rammler average particle size was 345 μm (63% of that of the base powder) and the fines content (<125 μm) was less than 10%.

The sodium sulphate had a bulk density of 1380 g/liter, a Rosin-Rammler average particle size of 290 μm (53% of that of the base powder) and a fines content (<125 μm) of less than 15%. It will be noted that this material constituted about 56% of the postdosed ingredients.

The final powder had a bulk density of 705 g/liter (195 g/liter greater than the base powder) and had excellent powder properties; it was crisp and free-flowing and showed no tendency to segregate. Its dynamic flow rate was 106 ml/s. The degree of hydration of the sodium tripolyphosphate was shown by X-ray diffraction analysis to be about 90%.

EXAMPLE 3

This Example describes a powder containing a higher level of nonionic detergent in the base powder: no nonionic detergent was postdosed. The base powder, which was prepared using a batch slurry-making process, had the following formulation:

| | % |
|---|---|
| Sodium linear alkylbenzene sulphonate | 9.0 |
| Nonionic detergent | 4.0 |
| Soap | 0.75 |
| Sodium tripolyphosphate | 21.0 |
| Sodium sulphate | 5.0 |
| Sodium carbonate | 5.0 |
| Alkaline sodium silicate | 6.0 |
| Minor ingredients | 3.5 |
| Moisture | 13.5 |
| | 67.75 |

The bulk density was 500 g/liter, the Rosin-Rammler average particle size was 560 μm, and the fines content (<125 μm) was 4.4%. The dynamic flow rate was 85 ml/s.

The following ingredients were postdosed to the base powder:

| | % |
|---|---|
| Sodium sulphate | 20.29 |
| Bleach and minor ingredients | 11.96 |
| | 32.25 |

The bulk density of the postdosed material was 1050 g/liter, its Rosin-Rammler average particle size was 334 μm (60% of that of the base powder), and the fines content (<125 μm) was less than 11%.

The sodium sulphate had a bulk density of 1380 g/liter, a Rosin-Rammler average particle size of 290 μm (52% of that of the base powder) and a fines content of less than 15%. It constituted 63% of the postdosed ingredients.

The final product had a bulk density of 665 g/liter (165 g/liter greater than the base powder) and a dynamic flow rate of 110 ml/s.

EXAMPLE 4

A spray-dried base powder containing no salts other than sodium silicate was prepared to the following formulation, using a batch slurry-making process:

| | % |
|---|---|
| Sodium linear alkylbenzene sulphonate | 9.0 |
| Nonionic detergent | 1.0 |
| Sodium tripolyphosphate | 21.5 |
| Sodium alkaline silicate | 5.5 |
| Minor ingredients | 3.5 |
| Moisture | 8.8 |
| | 51.3 |

A further 2.0% of nonionic detergent was sprayed onto the base powder.

The bulk density was 545 g/liter, the Rosin-Rammler average particle size was 690 μm, the fines content (<125 μm) was 5.3%, and the dynamic flow rate was 115 ml/s.

The following ingredients were postdosed:

| | % |
|---|---|
| Sodium sulphate | 30.9 |
| Sodium carbonate | 5.0 |
| Nonionic detergent | 1.0 |
| Bleach and minor ingredients | 11.8 |
| | 48.7 |

The bulk density of the postdosed material was 1180 g/liter, its Rosin-Rammler average particle size was 363 μm (53% of that of the base powder), and the fines content (125 μm) was less than 11%.

The sodium sulphate, which constituted 63% of the postdosed ingredients, had a bulk density of 1380 g/liter, a Rosin-Rammler average particle size of 290 μm (42% of that of the base powder) and a fines content (<125 μm) of less than 15%.

The final composition had a bulk density of 810 g/liter (265 g/liter greater than the base powder) and a dynamic flow rate of 123 ml/s.

COMPARATIVE EXAMPLE A

To show the density impact of postdosing sodium sulphate compared to incorporation in the base powder, a powder of the following composition was spray-dried using a batch slurry-making process:

| | % |
|---|---|
| Sodium linear alkylbenzene sulphonate | 9.0 |
| Nonionic detergent | 1.0 |
| STP | 21.0 |
| Alkaline sodium silicate | 5.5 |
| Sodium sulphate | 27.8 |
| Minors | 3.2 |
| Moisture | 6.8 |
| | 74.4 |

This product had a bulk density of 495 g/liter and was crisp and free flowing, the dynamic flow rate being 125 ml/s. Note the high level of sodium sulphate incorporated in the slurry. Precautions were taken to ensure good hydration of the phosphate to a level of over 80%.

To this base powder the following components were postdosed:

| | % |
|---|---|
| Sodium carbonate | 6.0 |
| Sodium sulphate | 3.2 |
| Nonionic detergent | 3.0 |
| Bleach and minors | 13.4 |
| | 100.0 |

The bulk density of the postdosed material was 700 g/liter, its Rosin-Rammler average particle size was 460 μm, and the fines content (<125 μm) was less than 2%.

The final product had excellent flow properties, the dynamic flow rate being 110 ml/s. The bulk density after addition of the postdosed ingredients, however, was 540 g/liter, only 45 g/liter higher than that of the base powder.

COMPARATIVE EXAMPLE B

A powder corresponding to a commercially available product having a conventional phosphate level (31% sodium tripolyphosphate) was prepared by spray-drying a slurry, using a continuous process, to give a base powder containing the following ingredients:

| | % |
|---|---|
| Sodium alkylbenzene sulphonate | 8.5 |
| Nonionic detergent | 4.0 |
| Sodium tripolyphosphate | 31.0 |
| Sodium sulphate | 2.5 |
| Sodium carbonate | 5.0 |
| Sodium silicate | 6.0 |
| Minor ingredients (fluorescer, antiredeposition agent etc) | 1.5 |
| Water | 8.0 |
| | 66.5 |

To the spray-dried powder, which had a bulk density of about 450 g/liter, the following ingredients were postdosed:

| | |
|---|---|
| Sodium sulphate (anhydrous) | 17.5 |
| Bleach ingredients (sodium perborate, TAED, stabilizer), and minor ingredients (enzyme, lather suppressor, perfume etc) | 16.0 |
| | 33.5 |

The bulk density of the final product was about 560 g/liter. This could be varied slightly by adjustment of the aeration of the spray-dried powder.

The degree of hydration of the sodium tripolyphosphate in the powder was found by X-ray diffraction analysis to be about 50%.

In the following experiment the effect of salts on the hydration of sodium tripolyphosphate and consequently on powder properties will be demonstrated.

Two slurries were made by a continuous process in which all components were mixed simultaneously in a continuous mixing vessel under very similar conditions. The compositions of these slurries were as follows:

| | X | Y |
|---|---|---|
| Sodium linear alkylbenzene sulphonate | 9.0 | 9.0 |
| Nonionic detergent | 1.0 | 1.0 |
| STP | 21.5 | 21.5 |
| Minor ingredients | 2.7 | 2.7 |
| Sodium carbonate | 0 | 5.0 |
| Sodium sulphate | 0 | 5.0 |

-continued

| | X | Y |
|---|---|---|
| Moisture | 30.0 | 32.0 |

Using X-ray diffraction techniques the level of STP hydration was measured as a function of time after leaving the mixing vessel. The results were as follows:

| time (min) | X | Y |
|---|---|---|
| 0 | 82 | 47 |
| 5 | 95 | 56 |
| 15 | 96 | 73 |
| 30 | 97 | 88 |

These results clearly illustrate the positive effect of omitting salts from the slurry to improve STP hydration, allowing shorter residence times for similar levels of hydration.

The effect of the level of STP hydration on powder properties can be illustrated by means of a base powder of the following compositions:

| | % |
|---|---|
| Sodium linear alkylbenzene sulphonate | 9.0 |
| Nonionic detergent | 4.0 |
| STP | 21.5 |
| Sodium carbonate | 5.0 |
| Sodium alkaline silicate | 6.0 |
| Minor ingredients | 0.8 |
| Moisture | 3.3 |
| | 49.6 |

Two powder samples, P and Q, were produced via process routes in which the level of hydration could be controlled to a very low or a high level. The following properties were obtained:

| | P | Q |
|---|---|---|
| Level of STP hydration | <10% | >80% |
| Bulk density (g/liter) | 540 | 540 |
| Dynamic flow rate (ml/s) | 0 | 76 |

Powder P was very sticky and could not be handled or stored. It contained many lumps: more than 40% of the particles were over 2000 μm in size. Powder Q with a similar moisture level was easy to handle and the level of coarse material was well below 15%. This clearly shows that powders of similar composition (including moisture level) may show very different powder properties, depending on the level of hydration of the STP.

EXAMPLES 5 and 6

Three base powders of slightly different compositions, but with significantly different particle size specifications, were prepared by spray-drying. Each was dosed with sodium sulphate with a bulk density of 1580 g/l, a Rosin-Rammer average particle size of 290 μm and a fines content (<125 μm) of less than 15%.

The base powder had the following compositions:

| | C | 5 | 6 |
|---|---|---|---|
| Sodium linear alkylbenzene sulphonate | 9.0 | 9.0 | 9.0 |
| Nonionic detergent | 4.0 | 4.0 | 2.0 |
| Soap | 0.8 | 0.8 | — |
| STP | 21.0 | 21.0 | 23.3 |

-continued

| | C | 5 | 6 |
|---|---|---|---|
| Alkaline sodium silicate | 6.0 | 6.0 | 6.0 |
| Sodium sulphate | 5.0 | 5.0 | 6.0 |
| Sodium carbonate | 5.0 | 5.0 | 5.0 |
| Minor ingredients | 3.6 | 3.5 | 2.7 |
| Moisture | 10.2 | 12.6 | 10.5 |
| | 64.6 | 66.9 | 64.5 |

The physical properties of these powders were as follows:

| | C | 5 | 6 |
|---|---|---|---|
| Bulk density (g/liter) | 520 | 505 | 515 |
| Dynamic flow rate (ml/s) | 90 | 83 | 113 |
| Average particle size (R-R d') | 410 | 445 | 510 |
| % < 125 μm | 3.5 | 5.9 | 3.9 |

It will be seen that all three base powders has good flow properties and the average particle size ranged from 410 to 510 μm.

To the base powders were postdosed the following components:

| | C | 5 | 6 |
|---|---|---|---|
| Sodium sulphate | 21.9 | 21.2 | 20.5 |
| Sodium carbonate | — | — | 1.0 |
| Nonionic detergent | — | — | 2.0 |
| Bleach and minor ingredients | 13.5 | 11.9 | 12.0 |
| | 100.0 | 100.0 | 100.0 |

The bulk density of these postdosed materials was about 1060 g/liter, the Rosin-Rammler average particle size was 330 μm and the fines content (<125 μm) was less than about 10%.

Bulk density and flow properties of these final products were:

| | C | 5 | 6 |
|---|---|---|---|
| Bulk density (g/liter) | 650 | 655 | 705 |
| Dynamic flow rate (ml/s) | 78 | 96 | 106 |

The increase of bulk density with the corresponding ratio of the mean particle size of postdosed material over base powder, expressed as a percentage, is:

| | | | |
|---|---|---|---|
| BD increase | 130 | 150 | 190 |
| Particle size ratio | 80% | 74% | 64% |

This example shows that at postdosing levels of about 35% (21% sodium sulphate, 14% other materials) the Rosin-Rammler average particle size of the postdosed material should be below 75% of that of the base powder to achieve a bulk density increase of 150 g/liter.

EXAMPLES 7 & 8

This Example shows the effect of the fines level of the postdosed material on the residues left in the dispenser of the washing machine.

A base powder having the following composition was prepared, using a batch slurry-making process:

| | % |
|---|---|
| Sodium linear alkylbenzene sulphonate | 9.0 |
| Nonionic detergent | 1.0 |
| Sodium tripolyphosphate | 21.5 |
| Alkaline sodium silicate | 5.5 |
| Minor ingredients | 3.5 |
| Moisture | 9.4 |
| | 49.9 |

The base powder had a bulk density of 550 g/liter, a Rosin-Rammler average particle size of 660 μm, a fines content (<125 μm) of 5.7% and a dynamic flow rate of 130 ml/s.

To the base powder were postdosed the following ingredients:

| | % |
|---|---|
| Sodium sulphate | 30.6 |
| Sodium carbonate | 5.0 |
| Nonionic detergent | 3.0 |
| Bleach and minor ingredients | 11.5 |
| | 50.1 |

Two different grades of sodium sulphate were used to prepare Compositions 7 and 8. The properties of the two grades were as follows:

| | 7 | 8 |
|---|---|---|
| Bulk density (g/liter) | 1500 | 1570 |
| Rosin-Rammler average particle size (μm) | 290 | 225 |
| Fines content (% < 125 μm) | 16 | 25 |

The properties of the total postdosed material were as follows:

| | 7 | 8 |
|---|---|---|
| Bulk density (g/liter) | 1070 | 1070 |
| Rosin-Rammler average particle size (μm) | 290 | 225 |
| Fines content (% < 125 μm) | 10 | 15 |

The dispensing properties of the final compositions were compared by determining the percentage residues (by weight) left behind in the dispenser of a Philips AWB 126/127 washing machine using a water inlet pressure of 50 kPa and a water inlet temperature of 5° C. The results, and the other physical properties of the two compositions were as follows:

| | 7 | 8 |
|---|---|---|
| Bulk density (g/liter) | 750 | 795 |
| Dynamic flow rate (ml/s) | 113 | 120 |
| Dispenser residue (%) | 1 | 11 |

EXAMPLE 9

The increase in bulk density achieved by the process of the invention could also be obtained by mixing a relatively fine base powder with coarser postdosed components. This option, however, involved a serious disadvantage in dispensing behaviour, as is demonstrated in this example.

Two detergent powders of similar composition but different particle size distribution were prepared.

The base powders had the following composition:

| | |
|---|---|
| Linear alkylbenzene sulphonate | 9.0 |
| Nonionic surfactant | 1.0 |
| STP | 21.5 |
| Alkaline sodium silicate | 5.5 |
| Sodium sulphate | 5.0 |
| Minors | 3.5 |
| Moisture | 11.2 |
| | 56.7 |

The base powders were mixed with the following postdosed components:

| | |
|---|---|
| Sodium sulphate | 24.0 |
| Sodium carbonate | 5.0 |
| Nonionic detergent | 3.0 |
| Bleach & minor ingredients | 11.2 |
| | 100.0 |

In the two products, the physical properties of the base powders and the postdosed components were as follows:

| Base powder | 9 | D |
|---|---|---|
| Bulk density (g/liter) | 460 | 460 |
| Rosin-Rammler average particle size (μm) | 615 | 444 |
| % of particles < 125 μm | 0.2 | 5.3 |
| Postdosed components | 9 | D |
| Bulk density (g/liter) | 1010 | 1010 |
| Rosin-Rammler average particle size (μm) | 327 | 737 |
| % of particles < 125 μm | 7.9 | 1.0 |

The physical properties of the final powders were as follows:

| | 9 | D |
|---|---|---|
| Bulk density (g/liter) | 585 | 630 |
| Rosin-Rammler average particle size (μm) | 460 | 514 |
| of particles < 125 μm | 5.5 | 6.5 |

It will be seen that the two powders were very similar in physical properties.

The dispensing properties were compared by determining the percentage residues (by weight) left behind in the dispensers of two different washing machines, using a water inlet pressure of 50 kPa and water inlet temperatures of 5° and 20° C. The results were as follows:

| | 9 | D |
|---|---|---|
| Philips AWB 126/127, 20° C. | 13 | 20 |
| Philips AWB 126/127, 5° C. | 5 | 28 |
| Thomson-Brandt, 20° C. | 0 | 11 |

Composition 9 in accordance with the invention was clearly superior to Comparative Composition D.

We claim:

1. A process for the preparation of a low-phosphate granular detergent composition comprising one or more anionic and/or nonionic detergent-active compounds, from 10 to 25% by weight of sodium tripolyphosphate, and sodium sulphate, which process comprises the steps of:

(i) spray-drying an aqueous slurry comprising from 10 to 25% by weight of sodium tripolyphosphate, from 0 to 6% by weight of sodium silicate, from 0 to 20% by weight (in total) of sodium sulphate and/or sodium carbonate, and one or more anionic and/or nonionic detergent-active compounds, to form a spray-dried base powder;

(ii) postdosing to from 40 to 75% by weight of said spray-dried base powder from 20 to 35% by weight of sodium sulphate; and (iii) postdosing from 0 to 40% by weight of other solid and/or liquid material;

the sodium sulphate postdosed in step (ii) and any solid material postdosed in step (iii) having an overall bulk density of at least 1000 g/liter and an overall Rosin-Rammler average particle size not exceeding 75% of the Rosin-Rammler average particle size of the base powder; the final composition having a bulk density at least 150 g/liter greater than that of the base powder; all percentages being based on the final composition.

2. A process as claimed in claim 1, characterised in that the base powder contains less than 10% by weight (in total) of sodium sulphate and/or sodium carbonate.

3. A process as claimed in claim 2, characterised in that the base powder contains less than 5% by weight of sodium carbonate.

4. A process as claimed in claim 2, characterised in that the base powder contains less than 5% by weight of sodium sulphate.

5. A process as claimed in claim 1, characterised in that the sodium sulphate postdosed in step (ii) and any solid material postdosed in step (iii) contain overall not more than 15% by weight of particles $<125$ μm.

6. A process as claimed in claim 5, characterised in that the sodium sulphate postdosed in step (ii) and any solid material postdosed in step (iii) contain overall not more than 10% by weight of particles $<125$ μm.

7. A process as claimed in claim 1, characterised in that the sodium sulphate postdosed in step (ii) has a bulk density of at least 1200 g/liter.

8. A process as claimed in claim 7, characterised in that the sodium sulphate postdosed in step (ii) has a bulk density of at least 1300 g/liter.

9. A process as claimed in claim 1, characterised in that the base powder has a Rosin-Rammler average particle size within the range of from 350 to 800 μm.

10. A process as claimed in claim 9, characterised in that the base powder has a Rosin-Rammler average particle size within the range of from 500 to 750 μm.

11. A process as claimed in claim 1, characterised in that the sodium sulphate postdosed in step (ii) and any solid material postdosed in step (iii) have an overall Rosin-Rammler average particle size of at least 200 μm.

12. A process as claimed in claim 1, characterised in that the sodium sulphate postdosed in step (ii) and any solid material postdosed in step (iii) have an overall Rosin-Rammler average particle size of at least 300 μm.

13. A process as claimed in claim 1, characterised in that the sodium sulphate postdosed in step (ii) and any solid material postdosed in step (iii) have an overall Rosin-Rammler average particle size within the range of from 300 to 400 μm.

14. A process as claimed in claim 1, characterised in that the sodium sulphate postdosed in step (ii) and any solid material postdosed in step (iii) have an overall Rosin-Rammler average particle size not exceeding 70% of the Rosin-Rammler average particle size of the base powder.

15. A process as claimed in claim 1, characterised in that the sodium sulphate postdosed in step (ii) and any solid material postdosed in step (iii) have an overall bulk density of at least 1050 g/liter.

16. A process as claimed in claim 1, characterised in that the final composition has a bulk density at least 200 g/liter greater than than of the base powder.

17. A process of claimed in claim 1, characterised in that the base powder has a bulk density within the range of from 400 to 650 g/liter.

18. A process as claimed in claim 1, characterised in that the base powder contains less than 15% by weight of particles $<125$ μm.

19. A process as claimed in claim 1, characterised in that step (i) is carried out continuously.

20. A low-phosphate granular detergent composition comprising one or more anionic and/or nonionic detergent-active compounds, sodium tripolyphosphate, and sodium sulphate, characterised in that:

(a) the composition contains a total of from 10 to 25% by weight of sodium tripolyphosphate;

(b) the composition has a bulk density of at least 650 g/liter.

(c) the composition comprises:

(i) from 40 to 75% by weight of a spray-dried base powder containing from 10 to 25% by weight of sodium tripolyphosphate, from 0 to 20% by weight (in total) of sodium sulphate and/or sodium carbonate, and one or more anionic and/or nonionic detergent-active compounds, the base powder having a Rosin-Rammler average particle size within the range of from 350 to 800 μm;

(ii) from 20 to 35% by weight of postdosed sodium sulphate; and (iii) from 0 to 40% by weight of other postdosed material, the postdosed sodium sulphate (ii) and any other solid postdosed material (iii) having an overall Rosin-Rammler average particle size not exceeding 75% of the Rosin-Rammler average particle size of the base powder (i);

all percentages being based on the final composition.

21. A composition as claimed in claim 20, characterised by a bulk density within the range of from 675 to 850 g/liter.

22. A composition as claimed in claim 20, characterised in that the postdosed sodium sulphate (ii) and any other solid postdosed material (iii) have an overall Rosin-Rammler average particle size within the range of from 200 to 400 μm.

* * * * *